US005516612A

United States Patent [19]

Vianco et al.

[11] Patent Number: 5,516,612

[45] Date of Patent: May 14, 1996

[54] TONER AND DEVELOPER COMPOSITIONS AND PROCESSES THEREOF

[75] Inventors: George W. Vianco, Walworth, N.Y.; Sheau Van Kao, Oakville, Canada; Michelle M. Bruzee, Rochester, N.Y.

[73] Assignee: Xerox Corporation, Stamford, Conn.

[21] Appl. No.: 286,373

[22] Filed: Aug. 5, 1994

[51] Int. Cl.[6] ..... G03G 9/097

[52] U.S. Cl. ..... 430/106; 430/110; 430/137

[58] Field of Search ..... 430/106, 110, 430/109, 137

[56] References Cited

U.S. PATENT DOCUMENTS 5,229,242 7/1993 Mahabadi et al. ..... 430/106.6

5,364,724 11/1994 Mahabadi et al. ..... 430/110

5,391,453 2/1995 Ong ..... 430/110

*Primary Examiner*—John Goodrow

*Attorney, Agent, or Firm*—John L. Haack

[57] ABSTRACT

Disclosed is a process for enhancing xerographic developer tribo product longevity comprising providing developer particles comprised of a toner comprised of at least one resin, pigment, charge additive, surface additive particles, a charge control agent retention additive or compound, and a carrier.

23 Claims, 1 Drawing Sheet

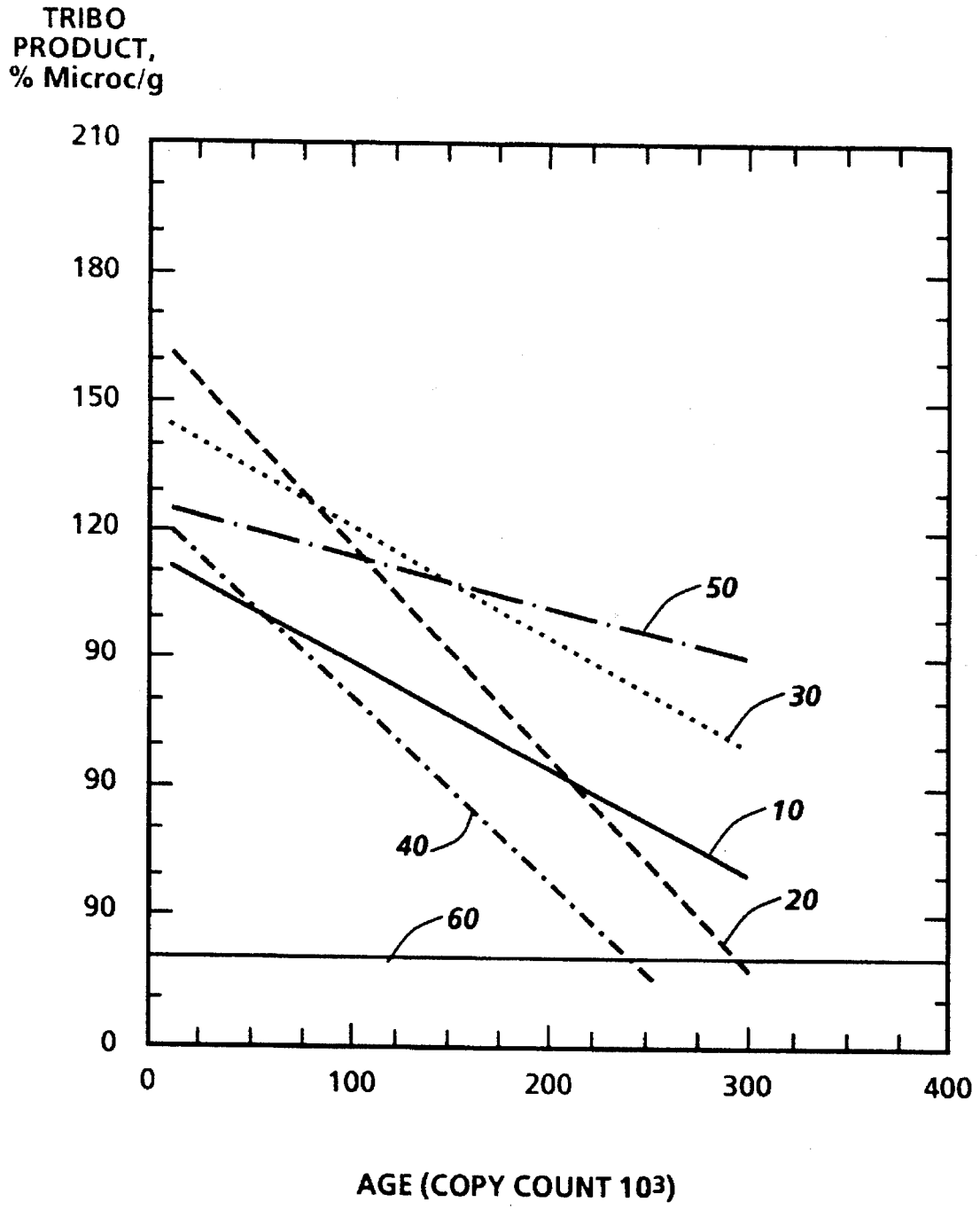
TRIBO
PRODUCT,
% Microc/g
210
180
150
120
90
90
90
0
0
100
200
300
400
AGE (COPY COUNT 10³)
50
30
10
40
20
60

TONER AND DEVELOPER COMPOSITIONS AND PROCESSES THEREOF

CROSS REFERENCE TO COPENDING APPLICATIONS AND RELATED PATENTS

Attention is directed to U.S. Pat. No. 5,229,242 (D/91096) Mahabadi, et al., entitled "Toner and Developer Compositions with Block or Graft Copolymer Compatibilizer".

Attention is also directed to copending application U.S. application Ser. No. 008/023,451 (D/91096C), filed Feb. 26, 1993, entitled "TONER AND DEVELOPER COMPOSITIONS WITH COMPATIBILIZER".

The disclosures of the abovementioned patents and copending applications are incorporated herein by reference in their entirety.

BACKGROUND OF THE INVENTION

This invention is generally directed to toner and developer compositions, and more specifically the present invention is directed to toner compositions, including magnetic, single component, two component and colored toner compositions, and imaging processes thereof, wherein at least one polymeric resin and a charge additive compound, including at least one wax component, can be selected such that the toner and developer compositions have enhanced development properties and improved copy quality performance for extended periods over the life time of the developer composition. In one embodiment of the present invention, toner compositions containing at least two polymers, and in other embodiments, from about 2 to about 10 polymers comprised of, for example, one or more resins and optional crosslinked resin, a wax component, and a charge control agent retention additive (CCARA) component are selected for use in the imaging processes. In another embodiment of the present invention, the toner compositions are comprised of resin particles, comprised especially a first resin and a second crosslinked resin, pigment particles, a wax component, such as polypropylene wax, and a copolymer CCARA, such as a block copolymer, or a graft copolymer. There is also provided in accordance with the present invention positively charged toner compositions comprised of resin particles, pigment particles, a wax component, such as polypropylene wax, and a copolymer charge control agent retention additive, such as a block copolymer, or a graft copolymer, and charge enhancing additives. In addition, the present invention is directed to developer compositions comprised of the aforementioned toners, and carrier particles. Furthermore, in another embodiment of the present invention there are provided single component toner compositions comprised of resin particles, magnetic components, such as magnetites, a wax component, such as polypropylene wax, and a copolymer charge control agent retention additive or compound, such as a block copolymer, or a graft copolymer, The toner and developer compositions of the present invention are useful in a number of known electrostatographic imaging and printing systems, especially those systems wherein a charge control agent and/or a wax is present in the toner. The developer compositions of the present invention, in embodiments, possess a wide fusing latitude, for example about 100° C., which is the temperature range between the minimum fixing temperature of, for example, from about 100° C. to about 170° C. required for fixing toner particles on paper and the hot, for example, from about 180° C. to about 250° C., offset temperature. The developer compositions of the present invention also provide toner images with low surface energy and a low frictional coefficient, which properties enable the effective release of paper from the fuser roll and provide for a reduction in image smudging. Further, the developer compositions and imaging processes of the present invention possess stable electrical properties for extended time periods, and with these compositions, for example, there is no substantial change in the triboelectrical charging values. The toner tribo product stabilizes quickly and maintains a high and constant level over many thousands of imaging cycles.

The following patents are of interest to the background of the present invention, the disclosures of which are incorporated by reference herein in their entirety:

U.S. Pat. No. 5,229,242, to Mahabadi, et al., discloses the use of a synthetic rubber, KRATON G1726X, commercially available from Shell Chemical. The compound is believed to act as a scavenger for free wax within the toner formulation. The synthetic rubber apparently reduces free wax domains that may be created during melt mixing. The synthetic rubber it is believed codissolves the wax component with the toner resin component or alternatively compatibilizes the wax and toner resin phases so that the wax content cannot become free or phase separated during micronization of the toner or in the product toner particles resulting therefrom. This reference also discloses other references which teach toner compositions containing resin particles and polyalkylene compounds such as polyethylene and polypropylene of molecular weight of about 1,500 to about 20,000. These polyalkylene compounds are believed to prevent offsetting in electrostatic imaging processes as disclosed in col. 2, lines 15 to 20 of the reference.

Other patents of interest include: U.S. Pat. No. 4,795,689 which discloses an electrostatic image developing toner comprising as essential constituents a nonlinear polymer, a low melting polymer, which is incompatible with the nonlinear polymer, a copolymer composed of a segmented polymer which is at least compatible with the nonlinear polymer, and a segmented polymer which is at least compatible with the low melting polymer, and a coloring agent, see the Abstract, and columns 3 to 10 for example; U.S. Pat. No. 4,557,991 which discloses a toner for the development of electrostatic images comprised of a certain binder resin, and a wax comprising a polyolefin, see the Abstract; also see columns 5 and 6 of this patent and note the disclosure that the modified component shows an affinity to the binder and is high in compatibility with the binder, column 6, line 25; and as collateral interest see U S. Pat. No. 3,965,021.

Developer and toner compositions with certain waxes therein, which waxes can be selected as a component for the toners of the present invention, are known. For example, there are illustrated in U.K. Patent Publication 1,442,835, toner compositions containing resin particles, and polyalkylene compounds, such as polyethylene and polypropylene of a molecular weight of from about 1,500 to about 20,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. Also, in U.S. Pat. No. 4,997,739, there is illustrated a toner formulation including polypropylene wax (MW: from about 200 to about 6,000) to improve hot offset. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference U.S. Pat. No. 3,635,704. Additionally, there are illustrated in U.S. Pat. No. 3,983,045 three component developer compositions comprising toner particles, a friction reducing material, and a finely divided non smearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

Described in U.S. Pat. No. 4,367,275 are methods of preventing offsetting of electrostatic images of the toner composition to the fuser roll, which toner subsequently offsets to supporting substrates such as papers wherein there is selected toner compositions containing specific external lubricants including various waxes, see column 5, lines 32 to 45.

However, there are various problems observed with the inclusion of polyolefin or other waxes, or wax-like additives, in toner formulations. For example, when a polypropylene wax is included in toner to enhance the release of toner from a hot fuser roll, or to improve the lubrication of fixed toner image it has been observed that the wax does not typically disperse well in the toner resin. As a result, free wax particles are released during the pulverizing step in, for example, a fluid energy mill and the pulverization rate is lower. The poor dispersion of wax in the toner resin and, therefore, the loss of wax will then impair the release function it is designed for. Scratch marks, for example, on xerographic developed toner solid areas caused by stripper fingers are observed as a result of poor release. Furthermore, the free wax remaining in the developer will build up on the detone roll present in the xerographic apparatus causing a hardware failure.

The toner formulations, in embodiments of the present invention, are comprised of resin particles, pigment particles, surface additives, for example, flow aids or lubricant release agents, and one or more charge control agent retention additives or compounds. Certain surface additives such as lubricants, and waxes in particular, do not have the above mentioned problem with phase separation from the toner formulations of the present invention as demonstrated by photomicrographic analysis of micronized toners. The wax domain size of toners formulations prepared in the present invention are approximately constant in size of from about 0.5 to about 2.0 micrometers in diameter. The wax domain size is not readily influenced by the presence of a charge control retention agent or synthetic rubber additive. However, the triboelectric properties of toner formulations of the present invention which do not contain a charge control agent retention additive are conspicuously short lived and are of little value in high volume or high speed xerographic printing processes.

All the problems mentioned above, and others can be eliminated, or minimized with the toner compositions and processes of the present invention in embodiments thereof. The release of wax particles is, for example, a result of poor wax dispersion during the toner mechanical blending step. All internal charge control additives should be dispersed well in the primary toner resin for them to impart their specific functions to the toner and thus the developer. Some of the charge control agent additives, such as quaternary ammonium salts, may become a separate molten phase during melt mixing or may transfer to the carrier surface during contact charging with the carrier particles. Some degree of success has been obtained by mechanical blending the toner formulation in certain types of mixers, such as the known Banbury mixer, where the temperature of melt can be maintained at a low level and polymer viscosities are not that far apart. However, it has been found difficult to generate an effective dispersions of certain charge control agents in compounding extruders where melt temperatures are typically higher.

The inclusion of a charge control agent retention additive or compound of the present invention is designed to overcome the inherent incompatibilities between different polymeric resins, between toner resin and wax, and more specifically, between the toner resin or resins and the charge control additive or between the wax and the charge control additive, thus widening the processing temperature latitude and enabling toner preparation in a large variety of equipment types, for example an extruder. The improvement in thermodynamic compatibility of the charge additive and other toner components also provides for a more stable dispersion of internally dispersed charge control additive compounds, such as quaternary ammonium salts, in the host resin which dispersion is stabilized against gross phase separation over time. Although not desired to be limited by theory, it is believed that the inhibition of phase separation of the charge control additive from other toner components, such as the resin component, by the charge control agent retention additive or compound, provides a mechanism for enhanced developer longevity and thereby stabilizes the developer tribo product characteristics and developer image quality.

A number of specific advantages are associated with the invention of the present application in embodiments thereof, including improving the dispersion of toner resin particles, especially a mixture of resins and wax; improving the dispersion of wax in the toner, thus eliminating the undesirable release of wax from the toner in the form of free wax particles during the pulverizing operation of the toner manufacturing process and the subsequent contamination of xerographic machine subsystems by these free wax particles; improving the dispersion of certain charge control additives in the toner resin or resins; avoiding the pulverizing rate reduction resulting from the poor wax dispersion; maintaining the intended concentration of wax in the toner to provide enhancement during release from the fuser roll and avoiding the undesirable scratch marks caused by the stripper fingers; a wide process latitude can be provided during the mechanical blending operation of the toner manufacturing process; enabling the effective mechanical blending of toner to be accomplished in a number of devices, including an extruder; and providing toner compositions with extended developer tribo product life time and xerographic development processes with improved stability and performance, and enhanced image quality.

SUMMARY OF THE INVENTION

It is a object of the present invention to provide toner and developer compositions which possess many of the above noted advantages.

Another object of the present invention resides in the provision of toner and developer compositions with stable triboelectrical characteristics for extended time periods.

In another object of the present invention there are provided toner and developer compositions that enable improved dispersion of resin and wax components achievable in a number of devices, including an extruder.

Moreover, another object of the present invention relates to the provision of toner and developer compositions with a charge control agent retention additive, and wherein for the resulting toners there is avoided, or there is minimized the undesirable generation of particles comprised entirely of a secondary polymer component during toner preparation. These particles can impair the function for which the secondary polymer component is designed.

In a further object of the present invention the toner mechanical blending operation can be accomplished at a melt temperature as high as 50° C. above the melting point of the wax component, thus enabling the use of a large number of apparatuses in addition to a low melt temperature mixing processes using equipment such as a Banbury mixer.

In yet another object of the present invention, the secondary polymeric phases in the toner will remain stable and substantial phase separation, especially over extended time periods of, for example, up to about three months in embodiments, does not take place.

Additionally, in yet another object of the present invention there are provided toner and developer compositions with certain waxes therein or thereon that enable images of excellent quality inclusive of acceptable resolutions, and that possess other advantages as illustrated herein such as low surface energy.

Another object of the present invention resides in the provision of a copolymer charge control agent retention additive compound in a toner wherein incompatible polymers, including at least one wax component, are present, and which copolymer compound can posses distinct segments or blocks, each compatible with at least one of the toner resins or toner polymers selected, especially when two toner polymers are selected, one of which may be a crosslinked polymer.

Yet another object of the present invention resides in the provision of processes for the preparation of toner compositions wherein the undesirable escape of the wax or charge control agent contained therein is avoided or minimized.

BRIEF DESCRIPTION OF DRAWING

The FIGURE is a graphical representation of measured tribo product versus developer age or copy life as measured by actual copy counts obtained for the respective developer formulations with and without the charge control agent retention additive compound or stabilizing additive present.

DETAILED DESCRIPTION OF THE INVENTION

The present invention is directed to toner formulations which greatly extend developer life. Developer life extension is accomplished in embodiments by the addition of a thermoplastic rubber component which is believed to act as a charge control agent retention additive. Extending the life of the developer is an important means for reducing xerographic material costs and improving customer satisfaction.

The present invention in embodiments provides for toner compositions and development process that use thermoplastic polymer blends to enhance developer life. The addition of a charge control agent retention additive or specific synthetic rubber compounds to thermoplastic resin containing toners optionally containing oligomeric waxes, extends xerographic developer life as measured by tribo charge, tribo product, and copy quality metrics such as background and solid area density. The tribo product is defined as the product of toner concentration (Tc) and the measured toner charge per mass ratio (Q/M) and is useful for predicting machine copy quality performance. The use of charge control agent retention additive compounds in positively charged toners greatly enhance developer life times and image quality performance. The charge control agent retention additive compounds of the present invention are selected from the group consisting of polymers including polystyrene, polyethylene/butylene, polyethylene/propylene, polystyrene/butadiene, polystyrene/isoprene styrene, and polyethylene/butylene, polypropylene, and mixtures or blends thereof. The monomers styrene, butadiene, ethylene, butylene, isoprene, and the like, can be combined as block copolymers or terpolymers to form the charge retention agent additives of the present invention as specified herein.

In embodiments, the present invention provides improved homogeneity to the components, such as resins, pigments, and charge control agent retention additives, and the like within the toner. The formulation of toner compositions of the present invention can be accomplished by combining one or more oligomeric waxes, a colorant such as carbon black, a quaternary ammonium salt and at least one toner resin polymer such as styrene/butadiene, styrene/n-butyl/methacrylate styrene/acrylate, and the like with a minor amount of a charge control agent retention additive. The charge control agent retention additive or in the alternative, the thermoplastic rubber additive compound can be added in concentrations of from about 1.0 to about 5.0 weight percent of the total toner composition weight. Various toner melt mix compounding processes can be used and include Banbury, extrusion, and the like.

In embodiments of the present invention, the above mentioned objects and other features can be accomplished by providing toner and developer compositions, and imaging processes thereof. More specifically, the present invention is directed to toner compositions comprised of resin particles, pigment particles inclusive of magnetites, waxes, and a charge control agent retention additive or charge stabilizing additive. In one embodiment of the present invention there are provided toner compositions comprised of first resin particles, second crosslinked resin particles, pigment particles, low molecular weight waxes, such as polyethylene and polypropylene, such as those available from Sanyo Chemicals of Japan as VISCOL 550P™ and VISCOL 660P™ and the like, and as a charge control agent retention additive selected from a block or graft copolymer. Furthermore, there are provided in accordance with the present invention positively charged toner compositions comprised of resin particles, pigment particles, low molecular weight waxes, a charge control agent retention additive compatibilizer, and a charge enhancing additive. Another embodiment of the present invention is directed to developer compositions comprised of the aforementioned toner and carrier particles, and imaging processes thereof wherein the developer tribo product longevity is enhanced.

A variety of thermoplastic charge control agent retention additive compounds were considered and evaluated, and are summarized in Table 1. Toners were prepared with the CCARA compounds indicated and described hereinafter and in the working Examples. The resultant toners had improved component homogeneity and dispersity, and also higher tribo product properties as measured in bench characterization for a

TABLE 1

Charge Control Agent Retention Additive Candidates

| Polymer Type | Producer/Product | Feature |
|---|---|---|
| Styrene/butadiene | Shell, KRATON D1118X | 80% Diblock |
| Styrene/butadiene · | Firestone, STEREON 840A | 43% Styrene $M_w$ 94,000 multiblock copolymer |
| Styrene/butadiene | Firestone, STEREON 730A | 30% Styrene $M_n$ 140,000 $M_w/M_n < 1.3$ |
| Styrene/butadiene/styrene | Scientific Polymer Products #451 | $M_w$ 100,000 |
| Styrene/ethylene/propylene | Shell KRATON G1701X | $M_w \sim 150,000$ |
| Styrene/ethylene/butylene-styrene | Scientific Polymer Products #452/3 | $M_w$ 118,000/89,000 |
| Styrene/ethylene/butylene-styrene | Shell KRATON G1726X | 70% Diblock $M_w \sim 40,000$ |
| Styrene/ethylene/butylene-styrene | Shell KRATON FG1901X | 2% anhydride |
| Styrene/ethylene/propylene-styrene | Shell KRATON G1702X | diblock |

series of toners that were similar to the Xerox Model 5100 toner formulations and were compared to control toner formulations which did not contain the charge control agent retention additive compound.

The accompanying Examples illustrate developer life extension for exemplary toner formulations prepared with synthetic thermoplastic rubber additives as charge control agent retention additives using extrusion melt processing with water injection. These toner formulations showed extreme tribo product stability as compared to toner formulation samples that were prepared by either continuous melt extrusion mixing or by Banbury without the charge control agent retention additives present. Although not desired to be limited by theory, these result are believed to be associated with the charge control agent retention additive acting not only as a retention additive, but also acting as a secondary charge control additive which charges positively relative to the carrier.

TABLE 2

Evaluation of Toners with Retention Additive

| Charge Control Agent Retention Additive (weight %) | Free wax (weight %) | Tribo charge (micro C/g) |
|---|---|---|
| CONTROL (0%) | 0.06 | 31.9 |
| 1% KRATON G1726X | <0.01 | 37.0 |
| 2% KRATON G1702X | <0.01 | 38.2 |
| 2% KRATON G1726X | <0.01 | 36.9 |

Referring to the FIGURE, exemplary results are shown for measured tribo product values versus developer age as measured by actual copies obtained. The reference numerals refer, respectively, to the results observed for a control toner 10 prepared by continuous melt mixing, which contains no charge control agent retention additive; a toner 20 prepared by Banbury mixing, without a retention additive present; a toner 30 prepared by Banbury mixing and 2 weight percent CCARA of KRATON G1726X; a toner 40 prepared by continuous extrusion on a twin screw extruder without a retention additive present; and a toner 50 containing 2 weight percent CCARA of the aforementioned KRATON G1726X which toner was also prepared by continuous extrusion in an extruder. Developers containing the charge retention additive, represented by toners 30 and 50 in the FIGURE, had the highest tribo product values or useful life times up to and beyond about 300,000 copies are expected to easily exceed 400,000 copies based on extrapolation and continuing observations. The control toner formulations 10, 20 and 40, with more negative slopes have expired or are rapidly approaching expiration or end of life as measured by approach to an arbitrary minimum performance specification of a tribo product of about 20 as indicated by line 60. Copy quality obtained at below a tribo product of about 20 is generally considered by those skilled in the art to be unacceptable for use in reprographic reproduction of text and line art.

In embodiments, when the known charge additive BONTRON P-51 available from Orient Chemical Co., was used as a charge additive compound in the above mentioned toner formulations, it was observed that the charge additive was not transferred as readily to the carrier component with the charge control agent retention additive present.

In addition, in accordance with embodiments of the present invention there are provided developer compositions comprised of toner compositions containing first resin particles like a styrene butadiene resin, second crosslinked resins of, for example, a styrene methacrylate crosslinked with known components such as divinylbenzene, pigment particles such as magnetites, carbon blacks or mixtures thereof, low molecular weight waxes, such as polyethylene, and polypropylene, such as those available from Sanyo Chemicals of Japan as VISCOL 550P™ and VISCOL 660P™, a charge control agent retention additive compound comprised of a block or graft copolymer, and charge enhancing additive, particularly, for example, distearyl dimethyl ammonium methyl sulfate, reference U.S. Pat. No. 4,560,635, the disclosure of which is totally incorporated herein by reference, and carrier particles. As carrier components for the aforementioned compositions, there can be selected a number of known materials like steel, iron, or ferrite, particularly with a polymeric coating thereover including the coatings as illustrated in U.S. Ser. No. 751,922, (abandoned) entitled Developer Composition with Specific Carrier Particles, the disclosure of which is totally incorporated herein by reference. One coating illustrated in the aforementioned copending application is comprised of a copolymer of vinyl chloride and trifluorochloroethylene with conductive substances dispersed in the polymeric coating inclusive of, for example, carbon black. One embodiment disclosed in the aforementioned abandoned application is a developer composition comprised of styrene butadiene copolymer resin particles, and charge enhancing additives selected from the group consisting of alkyl pyridinium halides, ammonium sulfates, and organic sulfate or sulfonate compositions; and carrier particles comprised of a core with a coating of vinyl copolymers or vinyl homopolymers.

Illustrative examples of suitable toner resins selected for the toner and developer compositions of the present invention, and present in various effective amounts, such as, for example, from about 70 percent by weight to about 95 percent by weight, include styrene acrylates, styrene methacrylates, styrene butadienes, polyesters, polyamides, epoxy resins, polyurethanes, polyolefins, vinyl resins, polymeric esterification products of a dicarboxylic acid and a diol comprising a diphenol; crosslinked resins; and mixtures thereof. Various suitable vinyl resins may be selected as the toner resin including homopolymers or copolymers of two or more vinyl monomers. Typical vinyl monomeric units include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole; N-vinyl pyrrolidone; and the like. The styrene butadiene copolymers, especially styrene butadiene copolymers prepared by a suspension polymerization process reference, U.S. Pat. No. 4,558,108, the disclosure of which is totally incorporated herein by reference, can be selected as the toner resin in embodiments.

As one toner resin, there can be selected the esterification products of a dicarboxylic acid and a diol comprising a diphenol, which components are illustrated in U.S. Pat. No. 3,590,000, the disclosure of which is totally incorporated herein by reference. Other toner resins include styrene/methacrylate copolymers, styrene/acrylate copolymers, and styrene/butadiene copolymers, especially those as illustrated in the aforementioned patent; and styrene butadiene resins with high styrene content, that is exceeding from about 80 to 85 percent by weight of styrene, which resins are available as PLIOLITES® and PLIOTONES® obtained from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol. In preferred embodiments, the toner is comprised of a mixture of resins comprised, for example, of a first resin as illustrated herein like styrene acrylate, styrene methacrylate, or styrene butadiene with a high styrene content, and a second polymer comprised of a crosslinked copolymer of styrene and butyl methacrylate. The aforementioned mixture of first and second resins can contain various effective amounts of each resin, for example from about 50 to about 90, and preferably about 70 weight percent of the first resin, like styrene butadiene, and from about 50 to about 10, and preferably about 30 weight percent of the second resin, like the resin crosslinked with, for example, divinylbenzene.

Numerous well known suitable pigments can be selected as the colorant for the toner particles including, for example, carbon black, like REGAL 330®, BLACK PEARLS®, VULCAN®, and the like, nigrosine dye, aniline blue, phthalocyanine derivatives, magnetites, and mixtures thereof. The pigment, which is preferably carbon black, should be present in a sufficient amount to render the toner composition colored thereby permitting the formation of a clearly visible image. Generally, the pigment particles are present in amounts of from about 2 percent by weight to about 20 percent by weight, and preferably from about 5 to about 10 weight percent, based on the total weight of the toner composition, however, lesser or greater amounts of pigment particles may be selected in embodiments.

When the pigment particles are comprised of known magnetites, including those commercially available as MAPICO BLACK®, they are usually present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black.

In another embodiment of the present invention there are provided colored toner compositions containing as pigments or colorants known magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, Lithol Scarlett, Hostaperm, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, Sudan Blue, and the like; while illustrative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. Also, there may be selected red, green, blue, brown, and the like pigments. These pigments are generally present in the toner composition in an amount of from about 2 weight percent to about 15 weight percent, and preferably from about 2 to about 10 weight percent, based on the weight of the toner resin particles.

Examples of low molecular weight, for example from about 1,000 to about 20,000, and preferably from about 1,000 to about 7,000, waxes include those as illustrated in the British 1,442,835 patent publication mentioned herein, such as polyethylene, polypropylene, and the like, especially VISCOL 550P™ and VISCOL 660P™. The aforementioned waxes, which can be obtained in many instances from Sanyo Chemicals of Japan, are present in the toner in various effective amounts, such as for example from about 0.5 to about 10, and preferably from about 3 to about 7 weight percent. Examples of functions of the wax are to enhance the release of paper after fusing, and providing the fused toner image with lubrication. The release or separation of wax from the toner can reduce these functions. Also, toners with poor wax dispersion have a lower pulverizing rate and the free wax which can remain with the toner will build up on the internal parts of the xerographic cleaning device causing a machine failure.

The charge control agent retention additives of the present invention generally are comprised of block or graft copolymers of the structure A-(block)-B, A-b-B-b-A or A-(graft)-B with the polymeric segments A and B each being compatible with a different polymer thereby permitting the compatibilizer to serve, for example, as a macromolecular surfactant. Examples of charge control agent retention additives include block copolymers, such as the KRATON® copolymers, available from Shell Chemical Company, and STEREON® copolymers, available from Firestone Tire and Rubber Company. For example, KRATON G1701X®, a block copolymer of styrene-ethylene/propylene, KRATON G1726X®, a block copolymer of styrene-ethylene/butylene-styrene, KRATON G1652®, a block copolymer of styrene-ethylene/butylene-styrene, STEREON730A®, a block copolymer of styrene and butadiene, and the like are suitable for improving the wax dispersion in styrenic resins. With KRATON G1701X® the A segment could be the styrene block and the B segment could be an ethylene/propylene block. In embodiments of the present invention, there are provided toners wherein the charge control agent retention additives of the formula A-b-B, A-b-B-b-A or A-g-B wherein A-b-B is a block copolymer of 2 segments, A and B, A-b-B-b-A is a block copolymer of 3 segments, A, B and A, and A-g-B is a graft copolymer of segments A and B, and wherein the polymeric segment A is identical or compatible to one of the polymer resin components present in the toner composition, that is the toner resin, whereas the polymeric segment B is identical or compatible with other polymer resin components and the charge control agent in the toner composition. Another source of block copolymers for use as CCARA compounds of the present invention is disclosed in U.S. Pat. No. 5,322,912, which disclosure is incorporated by reference herein in its entirety. Thus, in embodiments the aforementioned charge control agent retention additive can be comprised of rigid units such as styrene with the polymeric segment B being comprised of flexible, rubber-like units such as ethylene/propylene. The molecular weight of polymeric segment A can be from about 3,000 to about 100,000, and the molecular weight of polymeric segment B can be from about 10,000 to about 200,000. The charge control agent retention additive is present in various effective amounts, such as for example from about 0.5 to about 10, and preferably from about 1 to about 3 weight percent in embodiments.

Illustrative examples of charge control agents or charge enhancing additives present in various effective amounts, such as for example from about 0.1 to about 20, and preferably from 1 to about 5 weight percent by weight, include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives; and the like.

With further respect to the toner and developer compositions of the present invention, a component that may be present therein is the linear polymeric alcohol comprised of a fully saturated hydrocarbon backbone with at least about 80 percent of the polymeric chains terminated at one chain end with a hydroxyl group, which alcohol is represented by the following formula $$CH_3(CH_2)_nCH_2OH$$

wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, in a preferred embodiment of the present invention the polymeric alcohols selected have a number average molecular weight as determined by gas chromatography of from about greater than 450 to about 1,400, and preferably of from about 475 to about 750. In addition, the aforementioned polymeric alcohols can be present in the toner and developer compositions illustrated herein in various effective amounts, and can be added as uniformly dispersed internal, or as finely divided uniformly dispersed external additives. More specifically, the polymeric alcohols can be present in an amount of from about 0.05 percent to about 20 percent by weight. Therefore, for example, as internal additives the polymeric alcohols are present in an amount of from about 0.5 percent by weight to about 20 percent by weight, while as external additives the polymeric alcohols are present in an amount of from about 0.05 percent by weight to slightly less than about 5 percent by weight. Toner and developer compositions with the waxes present internally are formulated by initially blending the toner resin particles, pigment particles, charge control agent, charge control agent retention additive, and polymeric alcohols, and other optional components. In contrast, when the polymeric alcohols are present as external additives, the toner composition is initially formulated comprised of, for example, resin particles, charge control agent, charge control agent retention additive, and pigment particles; and subsequently there is added thereto finely divided polymeric alcohol particles.

Illustrative examples of carrier particles that can be selected for mixing with the toner compositions of the present invention include those particles that are capable of triboelectrically obtaining a charge of opposite polarity to that of the toner particles. Accordingly, the carrier particles can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of known carrier particles that may be selected include granular zircon, granular silicon, glass, steel, nickel, iron, ferrites, like copper zinc ferrites, available from Steward Chemicals, and the like. The carrier particles may include thereon known coatings like fluoropolymers, such as KYNAR®, polymethylacrylate, and the like. Examples of specific coatings that may be selected include a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride, and trichlorofluoroethylene; and other known coatings. There can also be selected as carriers components comprised of a core with a mixture, especially two, polymer coatings thereover, reference U.S. Pat. Nos. 4,937,166 and 4,935,326, the disclosures of which are totally incorporated herein by reference. Examples of carrier particles disclosed in the aforementioned patents can be prepared by (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000 microns, and preferably from about 75 to about 200 microns, thus allowing these particles to possess sufficient density and inertia to avoid adherence to the electrostatic images during the development process. The carrier particles can be mixed with the toner particles in various suitable combinations, such as from about 1 to about 3 parts per toner to about 100 parts to about 200 parts by weight of carrier.

The toner compositions of the present invention can be prepared by a number of known methods, including mechanical blending and melt blending the toner resin particles, pigment particles or colorants, charge control agent, charge control agent retention additive, optional additives, and polymeric waxes followed by mechanical attrition including classification. Other methods include those well known in the art such as spray drying, mechanical dispersion, melt dispersion, dispersion polymerization, and suspension polymerization. The toner particles are usually pulverized, and classified, thereby providing a toner with an average volume particle diameter of from about 7 to about 25, and preferably from about 10 to about 15 microns as determined by a Coulter Counter. The toner compositions of the present invention are particularly suitable for preparation in a compounding extruder such as a corotating intermeshing twin screw extruder of the type supplied by the Werner & Pfleiderer Company of Ramsey, N.J. The inclusion of charge control agent retention additive improved the thermodynamic compatibility between the primary and:the secondary polymer phases. As a result, the secondary polymer can be well dispersed into smaller domain size with improved adhesion to the primary resin. The smaller domain size and the better adhesion will then prevent the secondary polymer from separating into individual particles during the pulverization operation. Furthermore, the compatibilizing action can be functioning even at high melt temperatures, for example 50° C. above the melting point of the wax component when mechanical blending is difficult because of a vast difference in polymer viscosity. This advantage increases the process latitude of the mechanical blending operation. The advantage of including a charge control agent retention additive may not be limited to the mechanical blending process alone; thus, for example, improved dispersion and adhesion can be realized in other known preparation methods by using the toner compositions of the present invention. Also, high concentrations of a secondary polymer, such as wax, can be effectively dispersed in a toner by including an effective amount of charge control agent retention additive.

The toner and developer compositions of the present invention may be selected for use in developing images in electrostatographic imaging systems containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, titanyl phthalocyanines, and vanadyl phthalocyanines, while examples of charge transport layers include the aryl amines as disclosed in U.S. Pat. No. 4,265,990, the disclosure of which is totally incorporated herein by reference. Moreover, there can be selected as photoconductors hydrogenated amorphous silicon, and as photogenerating pigments squaraines, perylenes, and the like.

The toner and developer compositions of the present invention can be particularly useful with electrostatographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone.

The following examples are provided, wherein parts and percentages are by weight unless otherwise indicated. Comparative Examples are also provided.

EXAMPLE I

A toner composition comprised of 63.4 percent by weight of a styrene butadiene resin with 91 percent by weight of styrene and 9 percent by weight of butadiene, 19.1 percent by weight of a crosslinked, with 2 weight percent of divinyl benzene, styrene butylmethacrylate resin, 5 percent by weight of the polypropylene wax VISCOL 550P™, available from Sanyo Chemicals of Japan, 10 percent by weight of REGAL 330® carbon black (R330CB), 2 percent by weight of a charge control agent retention additive of styrene-ethylene/butylene-styrene block copolymer (Shell KRATON G1726X®), and 0.5 percent by weight of the charge enhancing additive distearyl dimethyl ammonium methyl sulfate, was prepared by mechanically blending the aforementioned components using a Werner & Pfleiderer ZSK30 twin screw extruder at barrel set temperatures ranging from 90° to 140° C. After pulverization and classification, toner particles with volume average diameter of about 11 microns as measured by a Coulter Counter, were obtained. The percent by weight of the free wax particles was determined to be less than 0.01 for all toners prepared. The free wax particles did not contain carbon black and, therefore, were lighter than the normal toner particles. A centrifugal separation technique based on the difference in specific gravity was then used to separate the lighter wax particles and determine the percent by weight of wax particles. Transmission electron microscope analysis of the above toner showed that domains of wax and crosslinked resin components were about 1 micron, the longest projected dimension measured on a TEM photomicrograph; all particles or domains were nonspherical; or less in the styrene butadiene continuous phase. The total wax remained inside the toner particles as determined by a differential scanning calorimeter and was found to be about 5 percent by weight, indicating the retention of all wax in the toner.

Subsequently, there was prepared a developer composition by admixing the aforementioned formulated toner composition mechanically blended in an extruder at 130° C. at a 4.5 percent toner concentration, that is 4.5 parts by weight of toner per 100 parts by weight of carrier with carrier comprised of a steel core with a coating, 0.8 weight percent thereover of a polyvinylidine fluoride and polymethyl methacrylate. Thereafter, the formulated developer composition was incorporated into an electrostatographic imaging device with a toner transporting means, a toner metering charging means, and a development zone as illustrated in U.S. Pat. No. 4,394,429. Atest run of 20,000 copies was carried out. The copy quality was judged excellent with good solid area and lines and no background throughout the aforementioned imaging test. The paper was released easily after the toner image was fused and no scratching was caused by stripper fingers present in the imaging device on developed solid areas as determined by visual examination.

EXAMPLE

A toner was prepared by repeating the procedure of Example I with the exception that a styrene-ethylene/propylene block copolymer (Shell KRATON G1701X®) was selected as the charge control agent retention additive instead of the styrene-ethylene/butylene-styrene block copolymer. The percent by weight of the free wax particles, determined by the same process as illustrated in Example I, was less than 0.01 weight percent for this toner.

Subsequently, there was prepared a developer composition by admixing the aforementioned formulated toner composition mechanically blended at 130° C. at a 4.5 percent toner concentration. The prepared developer composition was then incorporated into the same electrostatographic imaging device of Example I, and a test run of 20,000 copies was accomplished. The copy quality for the developed images was excellent throughout the test. The paper was released easily after fusing and no scratching was caused by stripper fingers on developed solid areas as determined by visual examination.

COMPARATIVE EXAMPLE I

In this example toner was made in a continuous mixer, a Banbury rubber mill and an extruder, without the rubber charge control agent retention additive of Example I. A toner with a retention additive was made on an extruder and a Banbury mill. The four toners were made with a base formulation displayed in Table 3. These toners were blended with 2.0% $TiO_2$ surface additive for 25 minutes in a Lodige blender. While the bench characterization does not show a tribo difference, reference Table 4, machine test data of toner made with the charge control agent retention additive had much longer developer life than toners melt mixed in a variety of ways but without the retention additive present.

TABLE 3

Formulation of Toners with Retention Agent

| Process | Resin 2733 | Pigment 6% | Waxes 6.5% | CCA (%) | CCARA (%) |
|---|---|---|---|---|---|
| Continuous mixer | PSB2733 | R330 CB | PE/PP | P51-(0.8) | 0 |
| Banbury/ rubber mill | PSB2733 | R330 CB | PE/PP | P51-(0.45) | G1726X(2) |
| Extruder | PSB2733 | R330 CB | PE/PP | P51-(0.8) | G1726X(2) |
| Extruder | PSB2733 | R330 CB | PE/PP | P51-(0.8) | G1726X(2) |

TABLE 4

Evaluation of Toners with Retention Agent

| Process | Charge Control Retention Agent (weight %) | Tribo Charge (micro C/g) |
|---|---|---|
| Continuous mixer | none | 15.6 |
| Banbury/rubber mill | none | 21.7 |
| Extruder | none | 17.9 |
| Extruder | 2% KRATON G1726X | 17.4 |

COMPARATIVE EXAMPLE II

A toner composition comprised of 63.4 percent by weight of a styrene butadiene resin with 91 percent by weight of styrene and 9 percent by weight of butadiene, 21.1 percent by weight of the crosslinked styrene butylmethacrylate resin of Example I, 5 percent by weight of the polypropylene wax of Example I, 10 percent by weight of REGAL 330® carbon black, and 0.5 percent by weight of the charge enhancing additive distearyl dimethyl ammonium methyl sulfate was mechanically blended using a Werner & Pfleiderer ZSK30 twin screw extruder at barrel set temperature of 130° C. After pulverization and classification, toner particles with volume average diameter of about 11 microns were obtained. The separation technique as in Example I showed that the percent by weight of the free wax particles was 0.06. Transmission electron microscope analysis of toner showed that wax domains larger than 2 to 3 microns in the longest projected dimension were observed in the styrene butadiene continuous phase. The total wax remaining inside the toner particles as determined by a differential scanning calorimeter was found to be only 3.3 percent by weight.

Subsequently, there was prepared a developer composition by admixing the aforementioned formulated toner composition at a 4.5 percent toner concentration with the carrier particles of Example I. The prepared developer composition was then incorporated into the same electrostatographic imaging device of Example I, and a test run was carried out. Scratch marks caused by stripper fingers were visible on the developed solid areas.

The disclosures of all the above-mentioned patents and publications are incorporated by reference herein in their entirety.

Other modifications of the present invention may occur to those skilled in the art subsequent to a review of the present application. The aforementioned modifications, including equivalents thereof, are intended to be included within the scope of the present invention.

What is claimed is:

1. A process for enhancing xerographic developer tribo product longevity comprising providing developer particles comprised of a toner comprised of at least one resin, pigment, charge additive, surface additive particles, a charge control agent retention additive or compound selected from the group consisting of a graft copolymer, and a block copolymer in an amount of from about 0.5 to about 10 weight percent, and a carrier wherein the developer life time or tribo product longevity of said developer particles is extended from about 300,000 xerographic copies in the absence of said charge control retention agent to about 400,000 xerographic copies in the presence of said charge control agent retention additives.

2. A process in accordance with claim 1 wherein the toner resin is selected from the group consisting of polyesters, styrene butadiene copolymers, styrene acrylate copolymers, styrene methacrylate copolymers, and mixtures thereof.

3. A process in accordance with claim 1 wherein the pigment is selected from the group consisting of magenta, cyan, yellow, red, blue, green, carbon black, magnetites, and mixtures thereof.

4. A process in accordance with claim 1 wherein the charge additive is selected from the group consisting of dimethyl distearyl ammonium methyl sulfate, dimethyl distearyl ammonium bisulfate, acetyl pyridinium halide, stearyl phenethyl dimethyl ammonium tosylate, and mixtures thereof.

5. A process in accordance with claim 1 wherein the surface additive particles are selected from the group consisting of metal salts of fatty acid, waxes, metal oxide particles, and metal oxide particles treated with metal salts of fatty acids or charge control additives.

6. A process in accordance with claim 6 wherein the toner resin component is further comprised of a second toner resin component comprised of crosslinked resin particles, and wax component particles.

7. A process in accordance with claim 1 wherein the charge control agent retention additive or compound is selected from the group consisting of compounds of the formula A-b-B, A-b-B-b-A or A-g-B wherein A-b-B is a block copolymer with two segments A and B; A-b-B-b-A is a block copolymer with three segments; and A-g-B is a graft copolymer with two segments A and B wherein A is the main chain segment and the B segment is grafted thereto.

8. A process in accordance with claim 1 wherein the charge control agent retention additive or compound is selected from the group consisting of a styrene-ethylene/butylene block copolymer, a styrene-ethylene/propylene block copolymer, a styrene-ethylene/butylene-styrene block copolymer, and mixtures thereof.

9. A process in accordance with claim 1 wherein the charge control agent retention additive or compound is present in an from about 1 to about 3 weight percent.

10. A process in accordance with claim 2 wherein the polyester is the product of a condensation reaction of dimethylterephthalate, 1,2-propanediol, 1,3-butanediol, and pentaerythritol; or is the product of a condensation reaction of dimethylterephthalate, 1,2-propanediol, diethylene glycol, and pentaerythritol.

11. A process in accordance with claim 6 wherein the first resin particles are present in an amount of from about 40 to about 90 weight percent, and second resin particles are present in an amount of from about 60 to about 10 weight percent based on the total weight of resin.

12. A process in accordance with claim 6 wherein the first resin particles are comprised of styrene butadiene, styrene acrylate, or styrene methacrylate and wherein the second resin particles are comprised of crosslinked polymer of styrene butadiene, styrene acrylate, or styrene methacrylate.

13. A process in accordance with claim 6 wherein the wax is a polyolefin, or mixture of polyolefins and has a weight average molecular weight of from about 1,000 to about 10,000.

14. A process in accordance with claim 13 wherein the polyolefin is polyethylene or polypropylene.

15. A process in accordance with claim 6 wherein the wax is present in an amount of from about 1 to about 10 weight percent.

16. A process in accordance with claim 6 wherein the wax is present in an amount of from about 2 to about 7 weight percent.

17. A process in accordance with claim 1 wherein the carrier particles are comprised of a core with a polymeric coating thereover.

18. A process in accordance with claim 6 wherein the charge control agent retention additive or compound is a copolymer A-B wherein the A segment is compatible with the first resin component, and the polymeric segment B is compatible to the second resin component.

19. A process in accordance with claim 15 wherein the polymeric segment A of the charge control agent retention additive or compound is comprised of rigid styrene segments, and the polymeric segment B is comprised of flexible, rubber-like segments.

20. A process in accordance with claim 15 wherein the charge control agent retention additive has a polymeric segment A molecular weight of about 3,000 to about 100,000, and the molecular weight of polymeric segment B is from about 10,000 to about 200,000.

21. A xerographic imaging process comprising: providing a development apparatus between an imaging member and a transporting member; providing developer particles comprised of a toner comprised of resin, pigment, charge additive, surface additive particles and a charge control agent retention additive or compound, and a carrier; and transporting said developer to a photoconductive imaging member by said transporting member wherein said toner is attached to images present on said imaging member causing development thereof and wherein the developer life time or tribo product longevity of said developer particles is extended.

22. A process according to claim 21 wherein the charge agent retention additive or compound is selected from graft copolymers or block copolymers selected from the group consisting of compounds of the formula A-b-B, A-b-B-b-A or A-g-B wherein A-b-B is a block polymer with two segments A and B; A-b-B-b-A is a block copolymer with three segments: and A-g-B is a graft copolymer with two segments A and wherein A is the main chain segment and the B segment is grafted thereto.

23. A process according to claim 6 wherein the charge control agent retention additive or compound has at least one segment A or B which is phase compatible with the charge control additive.

* * * * *